United States Patent [19]

Günther et al.

[11] 4,043,107

[45] Aug. 23, 1977

[54] ARRANGEMENT FOR AUTOMATICALLY CONTROLLING THE TRAVEL SPEED OF YARNS, FILAMENTS, AND THE LIKE IN MACHINES PROCESSING THE SAME

[75] Inventors: Gerhard Günther, Muhlhausen; Josef Stillig, Owen-Teck, both of Germany

[73] Assignee: Leuze-Electronic KG, Owen-Teck, Germany

[21] Appl. No.: 564,142

[22] Filed: Apr. 1, 1975

[51] Int. Cl.[2] ..... D01H 13/32

[52] U.S. Cl. ..... 57/34 R; 57/93; 242/36

[58] Field of Search ..... 57/34 R, 119, 156, 93, 57/97; 242/36, 37 R

[56] References Cited

U.S. PATENT DOCUMENTS

| | | | |
|---|---|---|---|
| 2,957,300 | 10/1960 | Balinson, Jr. | 57/34 R |
| 3,430,426 | 3/1969 | Bryan, Jr. et al. | 57/34 R |
| 3,523,413 | 8/1970 | Ford et al. | 57/34 R |
| 3,623,310 | 11/1971 | Mulligan | 57/34 R |
| 3,633,835 | 1/1972 | Beers | 242/36 |
| 3,648,026 | 3/1972 | Abe et al. | 242/36 X |
| 3,648,027 | 3/1972 | Ganong, Jr. et al. | 242/36 X |
| 3,680,299 | 8/1972 | Lee, Jr. | 57/34 R |
| 3,751,893 | 8/1973 | Goodhue et al. | 57/34 R |
| 3,844,101 | 10/1974 | Schwartz | 57/34 R X |
| 3,899,868 | 8/1975 | Lee, Jr. et al. | 57/34 R |
| 3,908,347 | 9/1975 | Vignon | 57/93 X |

*Primary Examiner*—Richard C. Queisser
*Assistant Examiner*—Charles Gorenstein
*Attorney, Agent, or Firm*—Michael J. Striker

[57] ABSTRACT

An apparatus is operative for processing yarns, filaments or other such elongated elements. An arrangement for controlling the travel of such elongated element includes a device for determining the number of elements breakages occurring per unit time and for generating a corresponding breakage-frequency signal, a device for establishing a reference breakage frequency, and a mechanism for automatically varying the speed of yarn travel as a function of the discrepancy between the reference breakage frequency and the breakage frequency indicated by the breakage-frequency signal.

16 Claims, 7 Drawing Figures

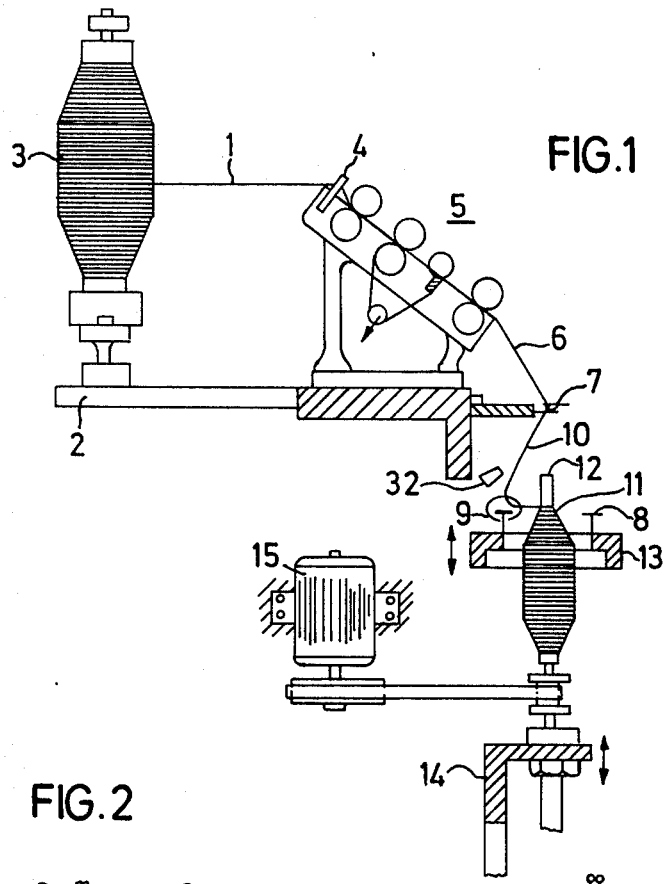
FIG.1
FIG.2
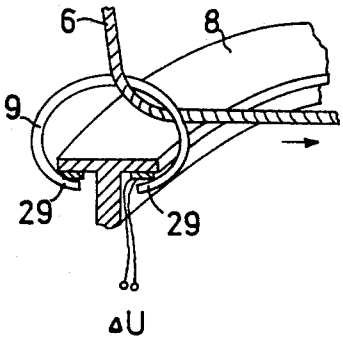
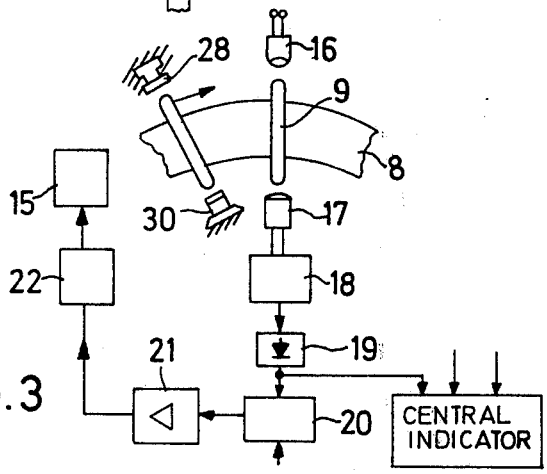
FIG.3

ARRANGEMENT FOR AUTOMATICALLY CONTROLLING THE TRAVEL SPEED OF YARNS, FILAMENTS, AND THE LIKE IN MACHINES PROCESSING THE SAME

BACKGROUND OF THE INVENTION

To increase the productivity of machines which process yarns, filaments and other elongated elements, it is possible, inter alia, to increase the yarn or filament travel speed of such machines. In the exemplary case of a spinning machine, this means an increase of the machine rotary speed. However, there are practical limits to the extent to which productivity can be boosted by boosting the rotary speed of the machine drive and accordingly the spindle speed. In particular, after a certain point, further increases in spindle rotary speed lead to yarn or filament breakages occurring at an unacceptably high frequency. Unacceptably high breakage frequencies are disadvantageous because, on the one hand, they decrease operating efficiency and, on the other hand, because they evidently have a negative effect upon the quality of the finished yarn, filament or other elongated element. For example, in the case of yarn being wound onto a cop, if the yarn breaks the partially filled cop is not replaced; instead, the broken yarn is tied, either manually or by means of an automatic knotter. Accordingly, the number of yarn breakages per unit time is directly reflected in the number of knots in the yarn per unit length and thus constitutes one elementary measure of quality.

Breakage of yarns, filaments or other elongated members in a function not only of the characteristics of the yarns of filaments, and of the processing operations to which they are subjected, including climatic conditions. Additionally, and in the exemplary case of a ring-traveller-type spinning machine, the yarn breakage frequency is dependent upon the mechanical and in general the physical characteristics of the machine and its operation, including those of the yarn-winding spindle and of the drawing mechanism. A further important cause of yarn breakage is high-frequency variation of the tensile load borne by the yarn (or other elongated element) attributable for the most part to imperfect mounting or geometry of the rotary and other components of the spinning mechanism.

Because of the many factors which contribute to breakages of yarns, filaments and other elongated elements, it is at best extremely difficult to determine the dominating cause or causes of high breakage frequency. For this reason, automatic intervention into the breakage-producing factors, which would be highly desirable, is scarcely possible. In this connection, it should be additionally noted that the causes which dominate may change with time, so that after a while different causes, for example temporary climatic conditions, may become the dominating causes of yarn breakage.

To the foregoing it should be added that in the past persons skilled in the art were limited to merely providing for the generation of optical or acoustic signals in response to yarn breakages.

SUMMARY OF THE INVENTION

It is a general object of the invention to create a situation making possible the determination of at least those factors which are primarily responsible for the yarn breakage frequency, with the aim of reducing or eliminating the effect of those factors, so as to achieve optimal-cost production conditions or, in the case of increasing demands upon quality and operation as well as mechanical-physical structural conditions, to utilize the possibilities within the framework of the invention in a manner characterized by optimum cost and suitability for manufacture.

These objects, and others which will become more understandable from the description, below, of preferred embodiments, can be met, according to one advantageous concept of the invention, by employing a measuring device which directly or indirectly monitors the travel of yarns, filaments, or other such elongated elements, in a processing machine in general, or in a spinning machine in particular. According to the invention, the measuring device advantageously forms part of a control or regulating circuit (e.g., a servo loop), and more particularly forms part of the device in such servo loop which is operative for generating a signal indicative of the actual yarn breakage frequency. In particular, the measuring device can furnish a number of signals proportional to the number of yarn breakages occurring per preselectable unit time, with these signals being applied to means for registering the actual-value signal, with the breakage-frequency indicating signal thusly generated being used, after the elapse of the time interval in question, for comparison against a reference breakage frequency, and with the discrepancy between the actual-value and desired-value breakage frequency signals being utilized as an error-correcting or compensating signal, which is applied to a compensating device or the like operative for varying the speed of the machine drive in a sense reducing the discrepancy. With such an arrangement, it becomes possible by introducing a certain preselected yarn breakage number, relative to a unit time, to so control the yarn travel speed of the machine that the preselected acceptable yarn breakage frequency is not markedly exceeded or fallen below. This means that the yarn travel speed of the individual machines, in dependence upon the respective product whose quality is to be optimized and in conjunction with the secondary requirements, can be properly selected automatically and then automatically maintained at an optimum value, so as to guarantee an optimum production cost for the yarns, filaments, or other elongated elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic side view of the working part of a ring spinning machine;

FIG. 2 is a perspective detail view of the ring and ring traveller of the spinning machine;

FIG. 3 is a top view of a portion of the ring and of the ring traveller, and of circuitry associated therewith;

DESCRIPTION OF THE PREFERRED EMBODIMENTS

Figure 4:
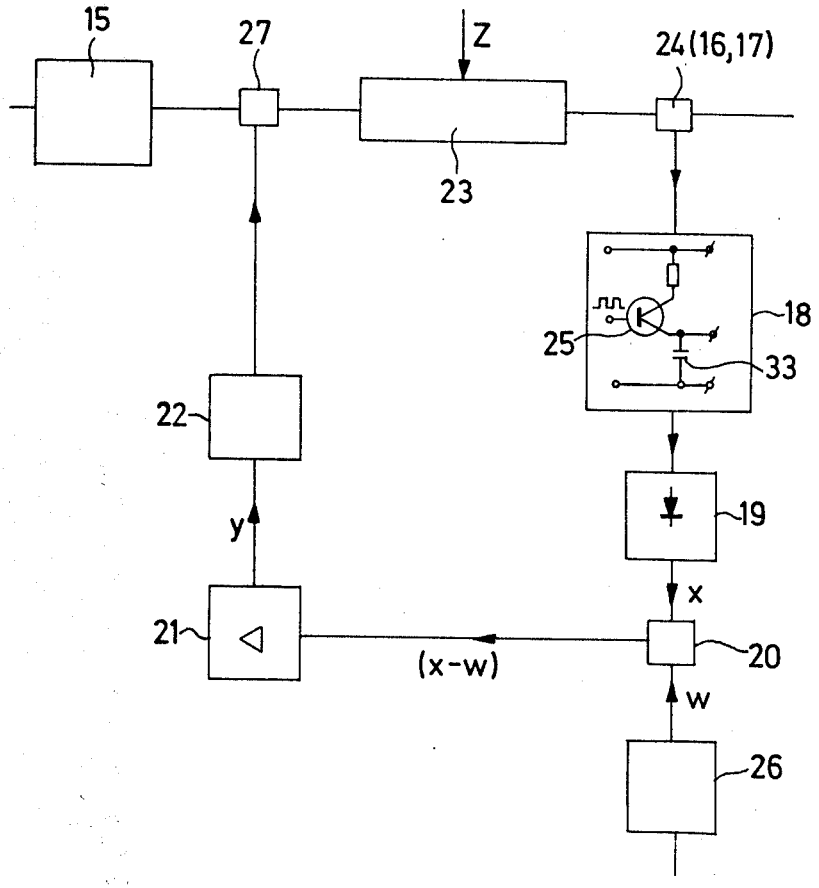
FIG. 4 is a schematic circuit diagram of a regulating arrangement.

As can be seen from the Figures, the yarn (spun or unspun), fiber yarn, filament yarn or filamentary structure 1 travels from a roving bobbin 3, passes through the so-called slubbing guide 4 and reaches the drawing mechanism 5, from which it emerges as fine yarn, then travels through the yarn-guide eyelet 7, and is wound onto the spool 11 by means of the ring-and-traveller arrangement 8, 9, with a yarn balloon 10 being formed during the winding, and with the spindle 12 upon which the spool 11 is mounted rotating with a constant rotary speed.

The winding action results from relative movement between the spindle 12 and the traveller 9. This relative movement results from the fact that, during spindle rotation, the traveller 9, as a result of frictional engagement with the ring 8, and as a result of the air resistance of the traveller 9, and also as a result of the air resistance of the yarn balloon 10, lags behind the spindle 12, i.e., turns at a lower rotary speed.

The winding of the yarn onto the spool 11 mounted on rotating spindle 12 proceeds from the bottom up, beginning with the yarn layers which form a conical portion, so that the yarn, in the event the yarn is to be further processed, can be pulled off the winding spool (cop) 11 at high speed.

In order that the yarn be wound onto the cop 11 in the illustrated manner, the ring rail 13 must rise and descend during the winding. To effect formation of a body of yarn wound on the cop 11 in the illustrated manner, it is accordingly necessary to continuously shift the ring rail in upwards direction, or else to continuously shift the spindle mounting structure 14 in downwards direction.

The drive motor 15 for the spindle 12, possibly serving also as the drive for the drawing mechanism 5 through the intermediary of a non-illustrated transmission, can be an A.C. or D.C. motor of the variable-speed type, and if desired of the regulated-speed variable-speed type.

For a constant rotary speed of the drive 15, fine yarn will be supplied from the outlet end of the drawing mechanism 5 at a velocity which is likewise constant. Accordingly, there devolves upon the traveller 9 the task of compensating for the diameter variation of the body of yarn wound on cop 11, which it achieves by travelling at a varying speed. A supplemental compensatory action results from the varying configuration of the yarn balloon 10 during the course of the complete winding of yarn onto the spool 12. The traveller 9, when it is located at the upper nose of the cop, has the lowest rotary speed, and accordingly in this situation the yarn tension is at the highest during this period of the winding.

Reference numeral 32 denotes a suction and blow-off arrangement.

According to the invention, and as schematically depicted in FIG. 3, there is associated with the ring traveller 9 a proximity detector, for example a photoelectric proximity detector comprised of a light source 16 and a photoelectric element 17 so arranged that the reception by receiver 17 of light from source 16 is interrupted during passage of the ring traveller 9 between these components. The photoelectric element 17 generates an electric pulse each time the ring traveller 9 passes between components 16 and 17. Connected to the output of photoelectric receiver 17 is the input of a pulse evaluation circuit 18. The evaluation circuit 18 receives the pulses from photoelectric element 17, shapes these pulses, and most importantly detects when pulses have ceased to be generated. When pulses have ceased to be generated, the pulse evaluation circuit 18 generates a yarn-breakage-indicating pulse, which is registered within circuit 18, for example by means of a counter. The counter is read out and reset at regular predetermined time intervals, for example once per minute. The count read out from the counter is registered on a register and represents the number of yarn breakages occurring, for example, per minute. This registered count constitutes the output signal of the pulse evaluation circuit 18. The output signal of circuit 18 could alternatively be an analog voltage or current.

This output signal, indicative for example of the number of yarn breakages occurring per minute, is transmitted, if necessary via a rectifier stage 19, to one input (or a corresponding set of inputs if the signals in question are all binary-coded, for example) of a comparator 20.

The comparator 20 is also supplied with a reference signal, which can be in binary-coded or other digital form, or can be in the form of an analog voltage or current, which is compared with the value of the controlled variable—i.e., the controlled variable here being directly the yarn travel speed and indirectly the number of yarn breakages occurring per unit time. Any indication of a deviation resulting from this comparison is represented as a signal, and this signal is applied to an amplifier 21 which generates a compensation signal, which is applied to the compensation stage 22 which is operative for changing or causing a change of, for example, the rotary speed of the drive motor 15.

As can be seen from the schematic circuit diagram of FIG. 4, the block designated with numeral 23 symbolically represents the controlled variable, namely the yarn travel speed. The change in the number of yarn breakages occurring per unit time is symbolically represented as an interference or disturbance signal input, since changes in the number of yarn breakages occuring per unit time have an effect upon the average yarn travel speed. Reference numeral 24 designates a measuring station, at which the components 16, 17 of FIG. 3 are located. The output signal of the measuring station are applied to the aforementioned pulse evaluating circuit 18, which may for example be essentially comprised of means for generating a breakage-indicating pulse in response to interruption of the pulse train furnished by measuring station 24, with these breakage-indicating pulses being used to gate a charging transistor 25, so as to cause a voltage buildup across the capacitor 33 corresponding in magnitude to the number of detected yarn breakages, with the capacitor 33 being periodically discharged, for example once per minute, i.e., after periodic sampling of the capacitor voltage prior to discharge thereof.

The regulated variable $x$ (number of breakage-indicating pulses registered per unit time, or equivalently a voltage or current having a magnitude or other characteristic proportional to or indicative of such number) is applied, if necessary via a rectifier stage 19, to a comparator 20. The comparator 20 also receives, from reference value selector 26, a reference value signal $w$. The comparator or subtractor 20, in the event the values of the signals $x$ and $w$ do not correspond, generates a deviation signal $(x-w)$ which it applies to a servo amplifier 21. The amplifier 21 supplies the corrective signal y to the compensation stage 22. In response to the receipt of such corrective signal $y$, the compensation stage 22 effects a compensatory adjustment of the adjustable speed control 27, resulting in a compensatory change in the rotary speed of the drive motor 15.

The compensation stage 22 may for example comprise a simple servo motor whose output shaft is connected to the speed-adjustment lever (27) of the drive motor 15, with the servo motor and its transmission exhibiting a conventional proportional-plus-integral input-output transfer function. Alternatively the adjustable speed control 27 might comprise a variable-firing-angle motor-speed-control circuit of the type wherein an electronic switch (such as a triac, or composed of two thyristors connected anti-parallel) is connected in series with the current path of the motor 15, with a first periodic voltage being applied across the motor current path and a second periodic voltage, usually of the same frequency as the first, being applied across the conductivity-control input of the electronic switch, with the phase shift between these two periodic voltages determining the fraction of a period during which motor current flows, and accordingly determining the average flow of energy into the motor 15. If a varible-firing-angle motor-speed-control circuit is employed for stage 27, then the compensation stage 22 could for example comprise a variable phase-shift stage operative for varying the aforementioned phase shift and consisting essentially of a variable impedance, such as a transistor whose conductivity varies continuously in dependence upon the magnitude of the corrective signal $y$.

Whatever the construction of the stages 22 and 27, the action of the corrective or compensation signal $y$ is such that the rotary speed of the drive motor 15 increases or decreases to such an extent as to cause the number of yarn breakages per unit time to come into coincidence with the number set on selector 26.

Of course, a plurality of such drive motors can be speed-regulated in this manner.

The photoelectric proximity detector 26, 27, or at least a part thereof, can be supported on the fly catcher 28 (FIG. 3) which is anyway present for cleaning of the ring traveller, or can be mounted on any other convenient structure. A gallium-arsenide diode is particularly well suited for use as the light source 16.

Figure 5:
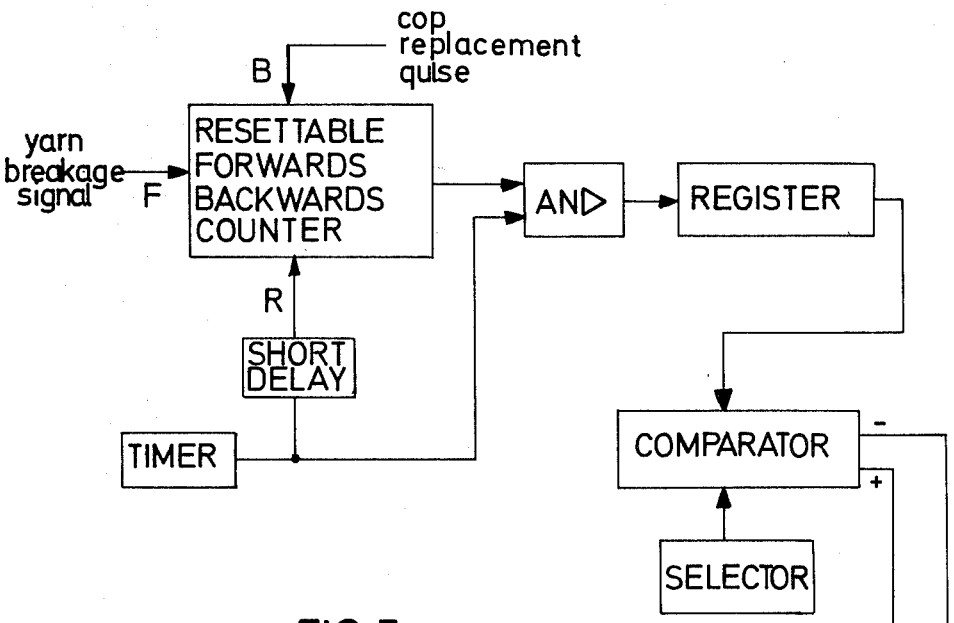
FIGS. 5–7 depict circuit details of additional regulating arrangements.
Figure 6:
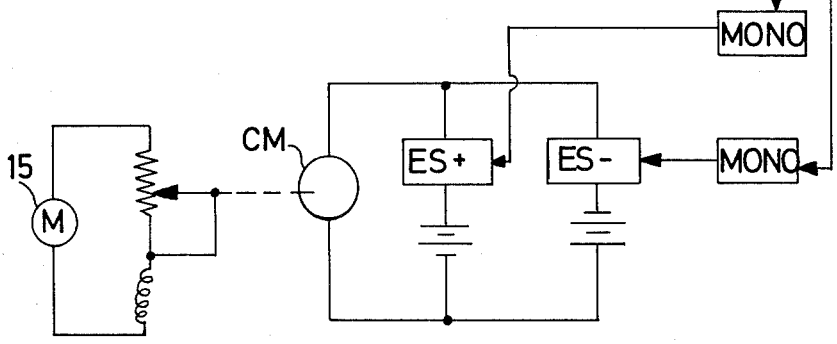
Figure 6:
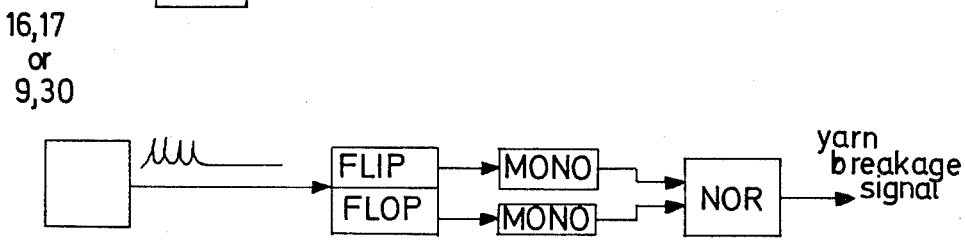

Another such control circuit is shown in FIGS. 5 and 6. FIG. 6 depicts, in block-diagram form, a circuit for generating a yarn-breakage-indicating signal. Each time the traveller 9 passes the photoelectric proximity detector 16, 17, a pulse is generated. The illustrated pulse train represents the pulses generated during normal operation; the prolonged zero-value portion following the pulses represents the period during which no pulses are generated because the yarn has broken and is being knotted either manually or by an automatic knotter. These pulses are applied to the toggle (complementing) input of a flip-flop. Each of the two flip-flop outputs is connected to the input of a respective one of two monostable circuits. The outputs of the two monostable circuits are connected to the two inputs of a NOR-gate. Both monostable circuits in FIG. 6 have the same astable-period-duration, and both are dynamically triggered (i.e., are triggered only when the input signal applied thereto changes from 0 to 1). So long as the traveller-synchronized pulses applied to the flip-flop are being generated at a frequency above a minimum frequency determined by the astable-period durations of the two monostable circuits, at least one of the two monostable circuits will always be in the triggered condition. However, if the yarn breaks, for a certain time interval, e.g., during automatic tying of the broken yarn, no pulses will be generated, and both monostable circuits will assume the stable state, i.e., the output signals of both monostable circuits will be 0 signals. This will cause the output of the NOR-gate to become a 1 signal. This 1 signal constitutes a yarn-breakage-indicating signal.

The yarn-breakage-indicating signal generated in FIG. 6 is applied to the F input of a resettable forwards-backwards counter, shown in FIG. 5, F, B and R respectively denoting the forwards-count signal input, the backwards-count signal input, and the reset signal input. The counter is dynamically triggered, i.e., is responsive only to signal transitions from 0 to 1.

The counter in FIG. 5 very simply counts up the number of yarn breakages which occur, for example during a fixed period of time such as 5 minutes or alternatively during the winding of a predetermined number of cops. Each time a filled cop is replaced by an empty cop, the traveller-generated pulses will temporarily cease; this causes generation (by the circuit of FIG. 6) of a yarn breakage signal which is then registered by the counter of FIG. 5. However, a mechanical trip switch, or the like, is provided on the spindle and is tripped when a filled cop is removed. This tripping results in the generation of a cop replacement pulse which is applied to the backwards-counting signal input B of the counter, compensating for the false yarn-breakage-indicating signal just mentioned, so that the count on the counter of FIG. 5 will correspond accurately to the true number of yarn breakages. Actually, the number of cop replacement operations occurring per unit time may be negligible compared to the number of yarn breakages occurring per unit time during optimum machine operation, in which case the just-mentioned compensation can be dispensed with, since the resulting slight inaccuracy in the computed number of yarn breakages will be acceptable.

In any event, the counter in FIG. 5 registers the number of yarn breakages which have occurred. The output of the counter is connected to one input of an AND-gate whose output is connected to the input of a register. A timer periodically (e.g., once per 5 minutes) generates a read-out pulse which it applies to the other input of the AND-gate. As a result, the AND-gate passes the count of the counter to the register, which registers such count, erasing any previously registered count. Persons skilled in the art will understand that while the counter output is shown as a single line connected to a single AND-gate, they may be considered merely symbolic in the event the counter processes signals in binary-coded form; in that event, the counter would for example have a plurality of outputs, for example two for each binary digit, and each output would be connected to one input of a respective one of a corresponding plurality of AND-gates, with the other input of each AND-gate being connected to the output of the timer. Likewise, the outputs of this plurality of AND-gates would be connected to a corresponding plurality of inputs of the register, symbolized in FIG. 5 by a single input line.

The read-out pulse generated by the timer also serves as a counter-reset pulse, being applied to the reset-signal input R of the counter via a short-delay delay stage. This short delay is provided to ensure that the count of the counter is read out before the counter is reset to zero.

In any event, it will be clear that the register will register a new count upon elapse of each preselected time interval, e.g., will register a new count after each 5 minutes or after the winding of 10 cops, or the like.

The count registered by the register is applied to the input of the comparator, in FIG. 5. Again, if the count is expressed in binary-coded form, the single line connecting the register output to the comparator output should be understood to symbolize a set of lines equal in number to the number of binary digits, or to twice the number of binary digits, in per se conventional manner.

Applied to the other input of the comparator, in FIG. 5, is a count equal to the desired number of yarn breakages, e.g., the desired number of yarn breakages per 5 minutes, or the like. Again, this desired number of yarn breakages can be expressed in binary-coded form, in which case the line joining the selector output to the second input of the comparator should be understood to symbolize a set of lines for applying to the comparator a binary-coded number in parallel form. The selector in FIG. 5 is manually settable to the desired number of yarn breakages per unit time.

The comparator has a plus output and a minus output. When the count applied from the register is greater than that applied from the selector, the signal at the plus output is 1 and the signal at the minus output is 0; when the count applied from the register is less than that applied from the selector, the signal at the plus output is 0 and the signal at the minus output is 1; when the count applied from the register equals the count applied from the selector, the signals at both the plus and minus outputs of the comparator are 0 signals.

The plus and minus outputs of the comparator, in FIG. 5, are connected to the inputs of respective monostable circuits. These monostable circuits are triggered dynamically, i.e., respond only to a change from 0 to 1 at the associated comparator output. Each of the two monostable circuits is associated with a respective one of two electronic swithces ES+ and ES−. When one of the two monostable circuits is triggered, it renders and maintains the associated one of the switches ES+, ES− conductive for a predetermined time interval equal to the duration of the unstable state of the monostable circuit. The electronic swithes ES+, ES− are connected in the positive- and negative-current paths of a compensating motor CM. When the switch ES+ is conductive, compensating motor CM is energized with positive current, and its output shaft turns in one direction; when the switch ES− is conductive, compensating motor CM is energized with negative current, and its output shaft turns in the opposite direction. The output shaft of compensating motor CM is mechanically coupled to and controls the movement of the wiper of a potentiometer connected in series with the shunt field winding of the drive motor 15. When the output shaft of the compensating motor CM turns a small distance, the setting of the speed-control potentiometer changes, and accordingly the rotary speed of spindle drive 15 is changed. If the breakage-frequency value registered by the register is greater than that chosen by the selector, the motor drive speed will be reduced by a limited amount. If this limited speed reduction does not bring the breakage frequency down to the selected value, then, in response to the next read-out of the counter in FIG. 5, a further limited speed reduction will be performed. Successive limited speed reductions will be performed until the desired breakage frequency is achieved. Likewise, if the actual breakage frequency is lower than the selected maximum permissible breakage frequency, the drive speed will be increased to a limited extent, in response to each successive read-out of the counter of FIG. 5, until the breakage frequency is brought up to the maximum permissible value.

For generating the yarn breakage signal, instead of the photoelectric proximity detector 16, 17 shown in FIG. 3, use could also be made of a proximity detector of the reflex type. According to a further concept of the invention, the ring 8, in the region of the sliding path of the traveller 9, can be provided with a pressure-responsive but friction- and temperature-resistant element 29, for example a piezoelectric ceramic (FIG. 2). When the yarn is being wound, the ring traveller 9 will exert upon the piezoelectric element 29 a pressure resulting in the generation of a measurable voltage across the piezoelectric element. If the yarn breaks, the ring traveller 9 suddenly ceases to exert such pressure, and the piezoelectric voltage undergoes a sudden change $\Delta U$, which can be amplified and applied to the pulse evaluation circuit 18.

Figure 7:
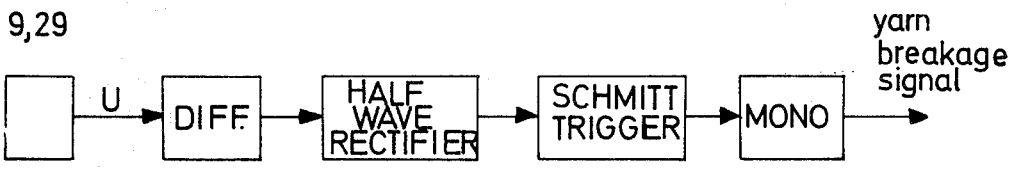

One method of doing this is depicted in FIG. 7. There the ring 9 and piezoelectric element 29 cooperate to generate the aforementioned piezoelectric voltage U, which is applied to the input of a differentiator. Upon yarn breakage, the sudden voltage change $\Delta U$ results in the generation at the differentiator output of a voltage spike, for example a negative voltage spike, which is passed by a half-wave rectifier to a Schmitt trigger. If the negative voltage spike is of a magnitude so great as to correspond to the sudden pressure decrease associated with yarn breakage, the Schmitt trigger triggers a dynamically triggered monostable multivibrator which in turn generates a well-shaped pulse constituting the yarn-breakage-indicating signal. The Schmitt trigger is provided to distinguish between high-magnitude voltage spikes associated with yarn breakage, and low-magnitude voltages associated with lesser pressure variations attributable to other causes. The half-wave rectifier is provided to block the voltage spike which is generated by the differentiator when the piezoelectric voltage U undergoes an opposite sudden change, upon resumption of yarn travel.

The yarn breakage signal, whether generated by photoelectric or by piezoelectric means, can be processed in the same manner.

Instead of the proximity detectors already discussed, use could also be made of an air-pressure-responsive proximity detector which, in the event the ring traveller 9 comes to a standstill as a result of yarn breakage, causes a signal to be generated, in a manner analogous to what has been described above, in response to the absence of air flow.

As a further possibility, there can be arranged close to the path of the ring traveller 9 a heat-responsive element 30 (FIG. 3). When the yarn, and accordingly the traveller 9, has been travelling for a period of time, the traveller 9 acquires an elevated temperature as a result of frictional contact with the guide ring 8. The passage of the warm or hot traveller 9 past the heat-responsive element 30 results in the generation of a pulse, in the same manner as did the passage of the traveller 9 between the elements 16, 17 of the photoelectric proximity detector. In the event of yarn breakage, these pulses cease to be generated, constituting an indication of yarn breakage. During automatic or manual tying of the broken yarn, the taveller 9 will of course cool some-what. Accordingly, upon resumption of yarn travel, the traveller 9 may require some time to reassume a temperature sufficient to be detected by the element 30. This delay can be compensated for by the provision of a time relay.

Finally, use can also be made of capacitive, inductive, or other known types of proximity detectors.

In the event that the number of yarn breakages occurring during the selected time interval is too large only for one or a few of the spindle units of a large spinning machine provided with many spindles, with accordingly the rotary drive speed and yarn travel speed of the one or few spindle units being always below the desired value at which the other spindle units are operating, then it is appropriate to reexamine the yarn characteristics, the operation of the drawing mechanism 5, the centering of the spindle, etc., but particularly the spindle mechanism. This is particularly the case since experience has shown that a relatively low number of spindles are responsible for a very high percentage of all the yarn breakages, and mainly as a result of faulty spindle centering.

To determine which spindle units are producing the most yarn breakages, it is useful to count the number of yarn breakages occurring during a certain time interval absolutely per spindle, so as to be able to then look into the operation of the "offenders".

In this way, it is possible to determine and establish the most economical yarn feed speed for the spinning machine, taking into account the maximum permissible yarn breakage frequency consistent with acceptable quality.

The yarn breakage frequency detector, or the yarn breakage detector thereof, or a plurality of such detectors, can be provided along the length of the whole yarn travel path at suitable locations, particularly in the region of the blow-off and suction arrangement 32 (FIG. 1). In this case, particularly well suited are proximity detectors responsive to air flow changes.

It will be understood that each of the elements described above, or two or more together, may also find a useful application in other types of circuits and constructions differing from the types described above.

While the invention has been illustrated and described as embodied in a yarn-travel-speed control arrangement in a ring spinning machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for processing yarns, filaments or other such elongated elements, an arrangement for controlling the travel of such elongated elements, comprising, in combination, means for determining the number of element breakages occurring per unit time and for generating a corresponding breakage-frequency signal; means for establishing a reference breakage frequency; and means operative for automatically varying the speed of travel of the element as a function of the discrepancy between said reference breakage frequency and the breakage frequency indicated by said breakage-frequency signal, the apparatus being a ring spinning machine comprised of a winding spindle and a cooperating ring and ring traveller for guiding the elongated element onto a holding member mounted on the winding spindle, and wherein said means for determining the number of element breakages comprises means operative for monitoring travel of the elongated element indirectly by monitoring the operation of the ring traveller.

2. In multi-unit machine for processing yarns, filaments or other such elongated elements, the machine being of the type comprised of a plurality of processing units each operative for processing a respective one of a plurality of such elongated elements, an arrangement for controlling the travel of such elongated elements, comprising, in combination, a plurality of breakage determining means, one for each processing unit, for determining the number of element breakages occuring per unit time at the respective unit and for generating a corresponding breakage-frequency signal associated with that processing unit; means for establishing a reference breakage frequency; and means operative for automatically varying the speed of travel of the element associated with each respective one of the processing units as a function of the discrepancy between said reference breakage frequency and the breakage frequency indicated by the breakage-frequency signal associated with the respective processing unit, whereby the travel speeds of the elements at the different ones of the processing units of the multi-unit machine are automatically optimized at different respective values.

3. The machine defined in claim 2, the multi-unit machine being a multi-spindle spinning machine comprised of a plurality of spinning units each provided with a respective winding spindle, the means for automatically varying the travel speed of the elements associated with the processing units comprising means for automatically varying the rotary speed of each winding spindle as a function of said discrepancy, whereby the winding spindles of a single spinning machine can wind at different respective rates each optimum for the respective winding spindle.

4. The machine defined in claim 2, wherein said means for determining the number of element breakages occurring per unit time comprises registering means for registering the number of element breakages occurring during a preselected time interval, and means for generating said breakage-frequency signal by periodically reading-out said registering means.

5. The machine defined in claim 2, wherein said means for determining the number of element breakages comprises an optical proximity detector.

6. The machine defined in claim 2, wherein said means for determining the number of element breakages comprises an electronic proximity detector.

7. The machine defined in claim 2, wherein said means for determining the number of element breakages comprises a pressure-responsive element-breakage detector.

8. The machine defined in claim 2, wherein said means for determining the number of element breakages comprises a temperature-responsive proximity detector.

9. The machine defined in claim 2, wherein said means for determining the number of element breakages comprises a capacitive proximity detector.

10. The machine defined in claim 2, wherein said means for determining the number of element breakages comprises an inductive proximity detector.

11. The machine defined in claim 2, each unit being a spinning machine provided with a blow-off arrangement, and wherein said means for determining the number of element breakages comprises a proximity detector arranged in the region of the blow-off arrangement.

12. The machine defined in claim 2, each unit being a spinning machine provided with a suction arrangement, and wherein said means for determining the number of element breakages comprises a proximity detector arranged in the region of the suction arrangement.

13. The machine defined in claim 2, each unit being a ring spinning machine provided with a winding spindle, and a cooperating ring and ring traveller, and being provided with a suction arrangement, and wherein said means for determining the number of element breakages comprises a proximity detector arranged intermediate the ring traveller and the suction arrangement.

14. The machine defined in claim 2, and further including central indicator means connected to said means for determining the number of element breakages and operative for providing a central indication of the number of element breakages occurring per unit time.

15. The machine defined in claim 2, wherein said means for determining the number of element breakages occurring per unit time is an analog device.

16. The machine defined in claim 2, wherein said means for determining the number of element breakages occurring per unit time is a digital device.

* * * * *